US006523195B1

(12) United States Patent
Rodier et al.

(10) Patent No.: US 6,523,195 B1
(45) Date of Patent: Feb. 25, 2003

(54) RAILED MOUNTED PATIENT LIFT

(75) Inventors: Sylvain Rodier, St-Ours (CA); Jean Bergeron, Canton Magog (CA)

(73) Assignee: Arjo Limited (GB)

( * ) Notice: Subject to any disclaimer, the term of this patent is extended or adjusted under 35 U.S.C. 154(b) by 235 days.

(21) Appl. No.: 09/668,921

(22) Filed: Sep. 25, 2000

(30) Foreign Application Priority Data

Oct. 5, 1999 (CA) ..... 2284855

(51) Int. Cl.[7] ..... A61G 7/10
(52) U.S. Cl. ..... 5/83.1; 5/89.1
(58) Field of Search ..... 5/83.1, 81.1 R, 5/85.1, 89.1, 87.1; 212/315, 316

(56) References Cited

U.S. PATENT DOCUMENTS

| | | | |
|---|---|---|---|
| 5,023,434 A | | 6/1991 | Lanfer et al. |
| 5,141,183 A | | 8/1992 | Jurkowski et al. |
| 5,809,591 A | | 9/1998 | Capaldi et al. |
| 6,006,377 A | | 12/1999 | Asakawa |
| 6,079,578 A | * | 6/2000 | Dyson ..... 5/83.1 |

FOREIGN PATENT DOCUMENTS

| | | |
|---|---|---|
| FR | 2540087 A | 8/1984 |
| JP | 63/309257 A | 7/1980 |
| JP | 57/148945 A | 9/1982 |
| WO | 97/20535 | 6/1997 |

* cited by examiner

*Primary Examiner*—Alexander Grosz
(74) *Attorney, Agent, or Firm*—Roberts, Mlotkowski & Hobbes

(57) ABSTRACT

A rail mounted patient lift comprises a ceiling mounted rail, a carriage mounted for displacement along said rail, power operated drive means for displacing the carriage along the rail, a sling hanger secured to a flexible elongate support element, power operated lifting means for extending and retracting the elongate support element relative to the carriage, a manually operable controller and control circuit means for moving said carriage to a selected one of a plurality of different positions along the rail in response to a first command signal from the controller.

12 Claims, 3 Drawing Sheets

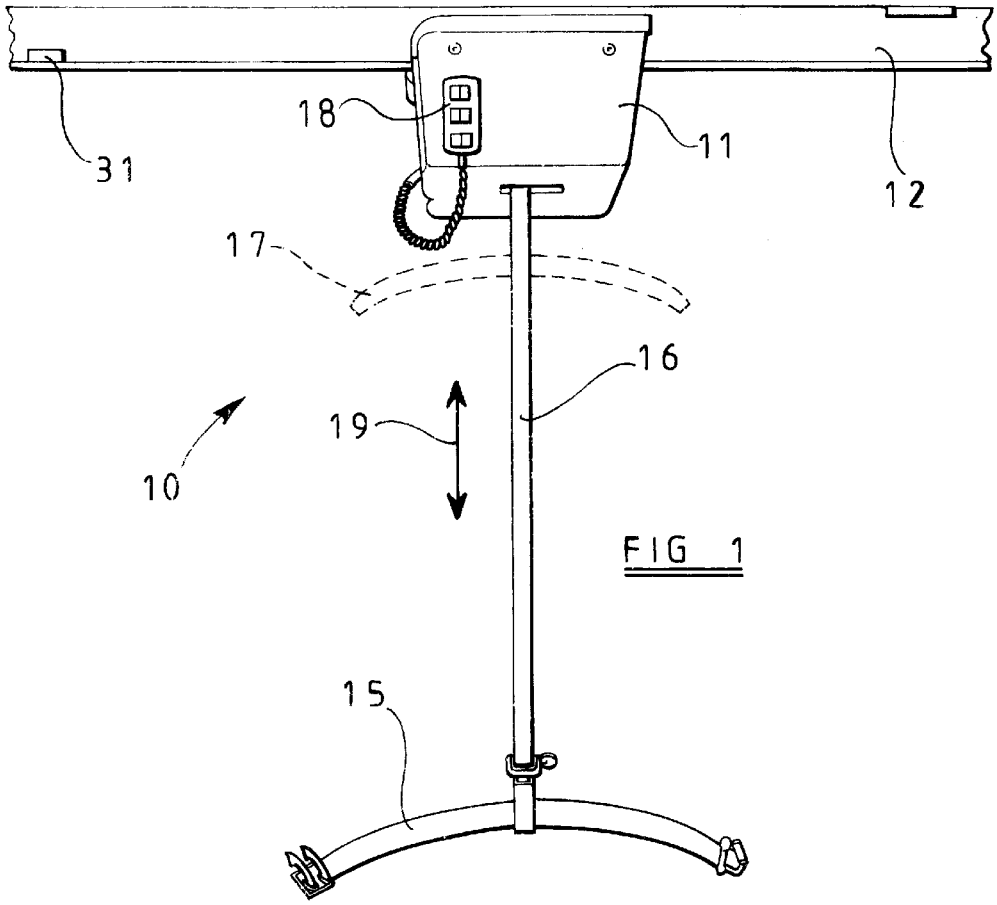
FIG 1
FIG 2
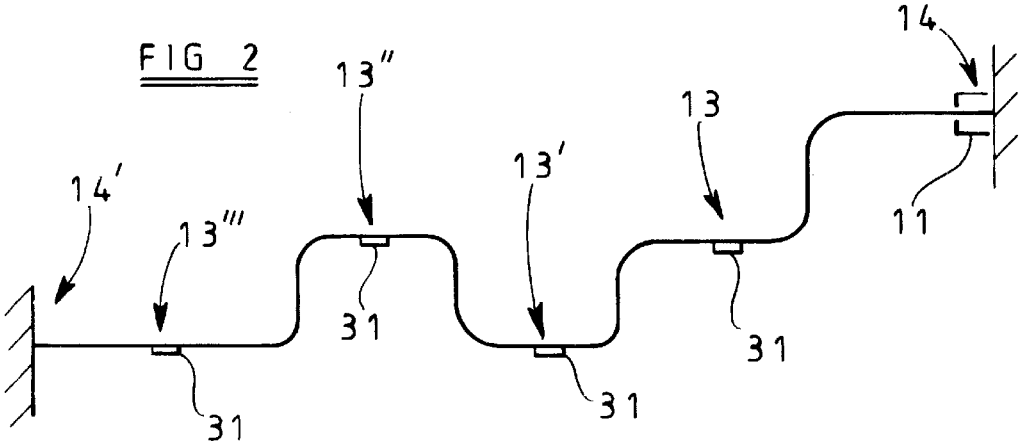

RAILED MOUNTED PATIENT LIFT

INTRODUCTION

The present invention relates to an a rail mounted patient lift.

It is known to displace rail mounted patient lifts along a rail to a desired location to attach and lift a patient and then move the patient by the lift. This is normally done by a hand-held controller device which an attendant operates to displace the lift carriage from a stored position, usually at an end of the rail and move it along the rail to a desired position. When doing so, the attendant will follow the carriage along the rail, with the controller in hand, to a position where a patient is then fitted with a harness to be attached to a sling hanger of the lift. The attendant then lowers the sling using the hand-held controller. Because these carriages are displaced at relatively slow speeds along the rail, it is time-consuming to retrieve the carriage from a stored position and move it to a desired position.

As is well known, in present day health care systems, the cost of operating the health care systems is of great concern. Therefore, if the time required to displace these lifts was to be greatly reduced, this would permit the attendant, usually a nurse's aide, to carry out other functions instead of walking by the lift as it is displaced from its stored position to a position of use and back to the storage position.

In other words, if the lift could be automatically displaced from a stored position to a desired position of use and effect other functions on its own safely, this would permit the nurse's aide to do other jobs such as the placement of a sling around the patient while the lift is being displaced to a position above the patient.

SUMMARY OF THE INVENTION

According to one aspect of the present invention, there is provided a rail mounted patient lift comprising a ceiling mounted rail, a carriage mounted for displacement along said rail, power operated drive means for displacing the carriage along the rail, a sling hanger secured to a flexible elongate support element, power operated lifting means for extending and retracting the elongate support element relative to the carriage, a manually operable controller and control circuit means for moving said carriage to a selected one of a plurality of different positions along the rail in response to a first command signal from the controller.

In the rail mounted patient lift, the control circuit means includes a programmable memory.

In the rail mounted patient lift, the control circuit means is operable to move the carriage to a predetermined homing position in response to a second command signal from the controller.

The rail mounted patient lift can further comprise a load detector for detecting if a load is present on the sling hanger, and the power operated lifting means is operable by the control circuit means to raise the sling hanger if in a down position with no load thereon when receiving a command signal from the controller to move the carriage along the rail.

The rail mounted patient lift can further comprise a plurality of location identifying means mounted at predetermined positions along the track and detector means mounted on the carriage for detecting the presence of the location identifying means.

In the rail mounted patient lift, the location identifying means are magnetic elements. The magnetic elements can be adhesively attached to the rail.

The rail mounted patient lift can further comprise audible sound generator means for emitting a sound when the detector means detects any of the location identifying means to signal the movement of the carriage and its location along the rail.

In the rail mounted patient lift, the control circuit means can be further provided with a sling hanger lowering function to lower the sling hanger to a desired preprogrammed position upon the carriage reaching a desired location.

In the rail mounted patient lift, the manually operated controller can have first and second switches for actuating the power operated lifting means (lift motor) to raise or lower the sling hanger, a station identification switch to instruct the control circuit means of a desired location along the rail, a homing switch for the carriage to automatically return to a homing position, and forward and reverse switches to displace the carriage in a desired direction along the rail when the sling hanger is in use.

In the rail mounted patient lift, the control circuit means identifies a selected position by detecting the distance of travel of the carriage along the rail.

According to another aspect of the invention there is provided a rail mounted patient lift comprising a ceiling-mounted rail, a carriage mounted for displacement along said rail, motorised drive means for displacing said carriage, a sling hanger secured to a retractable cable and vertically displaceable from said carriage by a lift motor, control circuit means for receiving command signals from a hand-operated controller, a load detector to detect if a load is present on said sling hanger, said control circuit operating said lift motor to retract said sling hanger if in a down position with no load thereon when receiving a command signal from said control circuit to freely move said carriage on said rail from a homing position, said control circuit having a programmable memory with a homing function to automatically return said carriage to said homing position when receiving a homing signal, and means to arrest said freely moving carriage at a desired position along said rail.

A preferred embodiment of the present invention will now be described, by way of example, with reference to the accompanying drawings.

FIG. 1 is a perspective view showing a rail mounted patient lift incorporating therein one embodiment of an automatic displacement and homing system, according to the present invention;

FIG. 2 is a schematic illustration showing a configuration of a ceiling-mounted rail supported from a ceiling in a room and having a predetermined number of position identification magnetic elements secured thereto;

DESCRIPTION OF THE PREFERRED EMBODIMENTS

Figure 3:
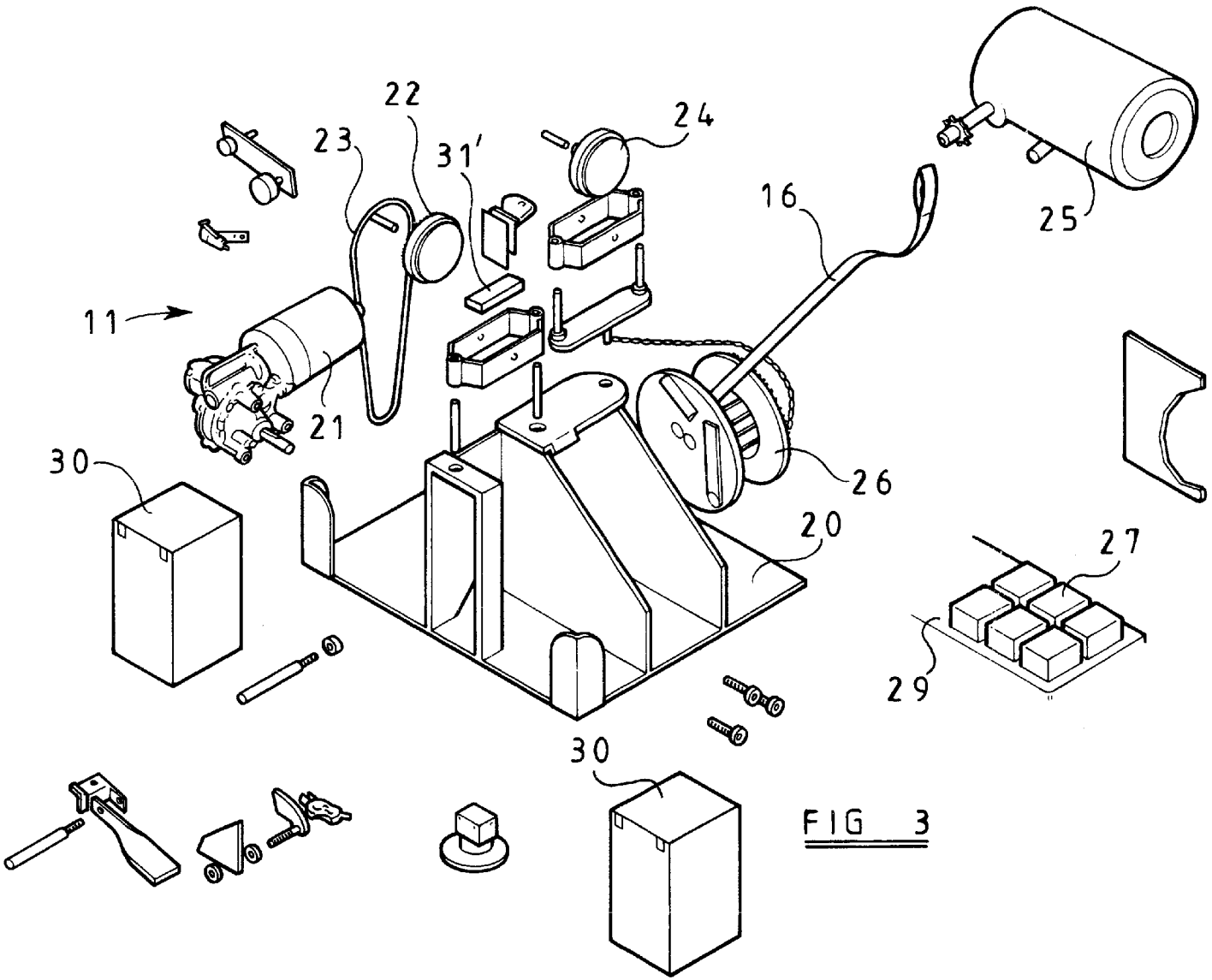
FIG. 3 is an exploded view showing the construction of the carriage and the various elements associated therewith.

Referring now to the drawings and more particularly to FIG. 1, there is shown generally at 10 a rail mounted patient lift. It comprises a carriage 11 which is displaceably secured to a ceiling mounted rail 12. As shown in FIG. 2, the rail 12 is configured to position the patient lift 10 at various locations or positions therealong, such as beds, bathing positions, etc., and these positions are identified herein by reference numerals 13, 13', 13" and 13"'. The carriage 11 is usually stored at a storage or homing position 14 or 14' which is usually at the end of the rail 12.

As shown in FIG. 1, a sling hanger 15 is suspended from a cable or strap 16 and movable vertically from a down position of use, as shown in FIG. 1, to a retracted stored position 17 as identified in phantom lines. A hand-operated controller 18, which may be carriage-mounted or remote, connects to an internal control circuit mounted on the carriage support frame and controls the displacement of the carriage 11 along the rail 12 and the displacement of the sling hanger 15 in an up-and-down direction as identified by arrow 19 whereby the user can attach the sling hanger 15 to a sling supporting a patient to raise the patient or lower the patient and displace him along the rail 12 to a desired location.

Referring now to FIG. 3, there is shown a typical construction of the patient lift and as hereinshown it comprises a carriage 11 having of a frame 20 which supports a drive motor 21 which operates a drive wheel 22 through a belt drive 23. The drive wheel 22 is engaged with the rail 12 and displaces the carriage therealong. An idle guide wheel 24 is spaced from the drive wheel and guides the carriage through curves and provides the proper spaced support for the frame 20. A lift motor drives a belt sheave 26 about which the belt or cable 16 is wound to move the sling hanger 15 up and down from the carriage. The lift motor is sufficiently strong to handle heavy weight patients. An electronic control circuit 27 having a programmable memory 28 is provided on a chipboard 29 and housed at an appropriate location on the frame 20. Battery supplies 30 provide the proper voltage for the operation of the motor and the control circuit. However, the supply may also be provided through an AC supply cable but the DC supply version is usually preferred. Other various component parts of the carriage are herein illustrated but will not be described as they do not form part of the present invention.

As shown in FIG. 3, a position detector 31' is secured at a convenient location inside the carriage and adjacent the lower edge of the track 12 to detect the presence of switching identifying means, herein constituted by one or more magnetic elements 31 which are secured adjacent the lower edge of the rail 12 to identify the various locations 13 to 13''' or work stations. These elements are simply small magnetic pieces which are adhesively attached to the rail and which are easy to remove to change the desired positions 13 to 13'''. When the position detector 31', e.g. a Hall effect device, senses the magnet 31 as the carriage approaches it, it sends a signal to the control circuit 27 which then effectuates a function with respect to the programmed memory circuit 28.

Figure 4:
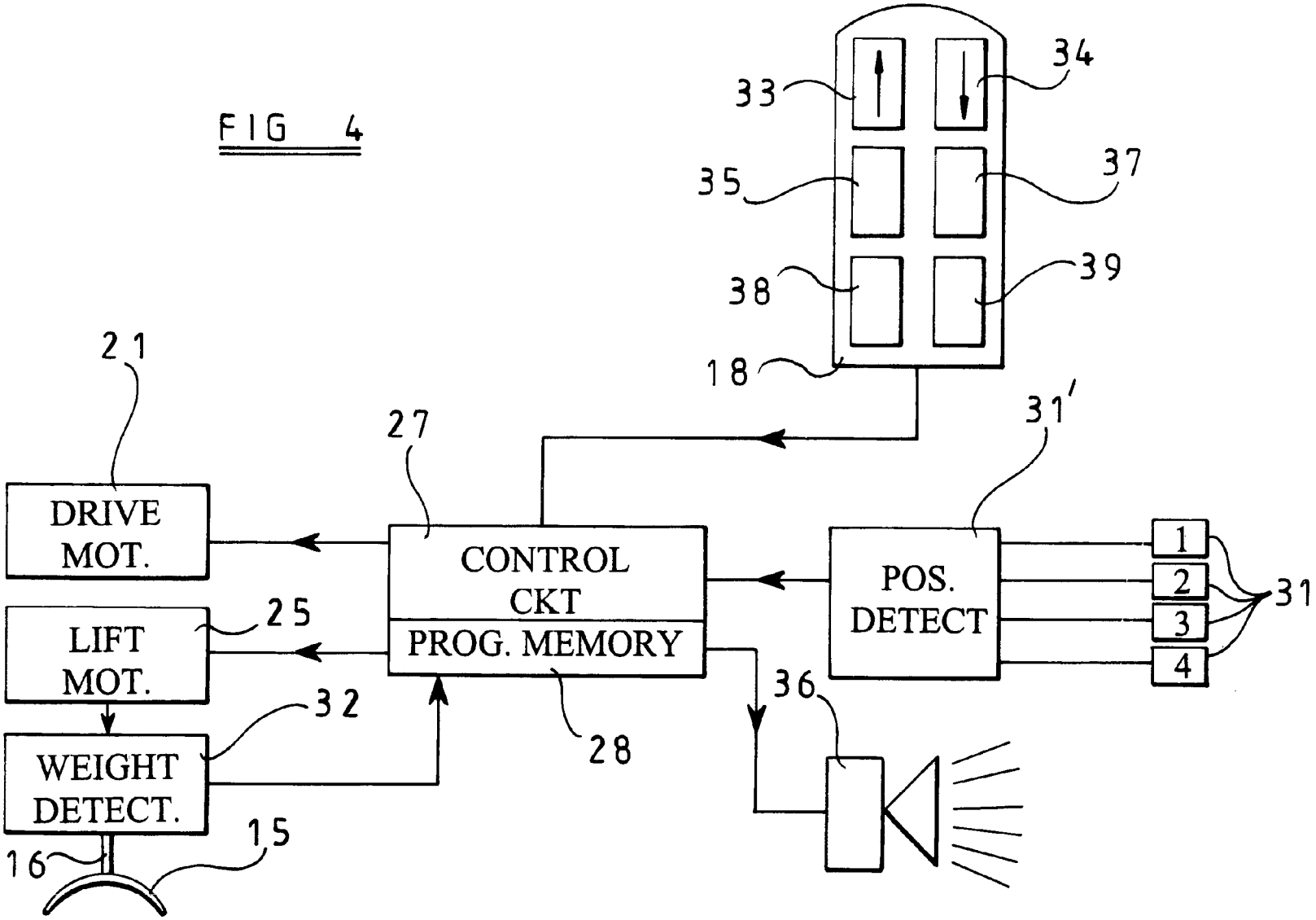
FIG. 4 is a block diagram of the control circuit and its associated circuitry.

As shown in FIG. 4, a load or weight detector 32 is associated with the cable sheave 26 of the sling hanger 15 and detects the presence of a load on the sling hanger. The control circuit 27 operates the lift motor 25 to retract the sling hanger when in a down position with no load thereon when receiving a command signal from the control circuit to freely move the carriage in a forward direction on the rail from the homing position 14. The control circuit programmable memory has a homing function to also automatically return the carriage when receiving a homing signal from the hand-operated controller 18.

As shown in FIG. 4, the hand-operated controller 18 has a first switch 33 for actuating the lift motor to raise the sling hanger 15 and a second switch 34 to actuate the lift motor to lower the sling hanger 15. As long as the switches 33 and 34 are depressed, the motor operates. When the switches are released, the motor will stop. The controller 18 is also provided with a station identification switch 35. If the rail is provided with four stations and the operator wishes the carriage to displace itself to the third station, he will depress the switch 35 three times. This will program the memory 28 to cause the control circuit to operate the drive motor 21 past the first and second positions 13 and 13'. As the carriage passes positions 13 and 13', it will emit an audible signal through the signal generator device 36 identifying that the carriage is in movement and has passed the first and second stations and is on its way to the third station. Upon reaching the third station the program memory will cause the control circuit to stop the drive motor 21. It is also conceivable that the controller may have a keypad with numbered stations so that by depressing a certain key the desired station will be identified and the control circuit, through its memory, will operate in the same manner to position the carriage adjacent that desired station.

The controller 18 is also provided with a homing switch 37 where upon being depressed the control circuit will lift the sling hanger 15 if there is no weight on it and once lifted will move the carriage 11 to its homing position, either position 14 or 14'. The program memory could also be programmed for each of the homing positions and this could be done by depressing switch 37 once for position 14 and twice for position 14', or again it could consist of a keypad which would identify the homing positions by individualized keys. Switches 38 and 39 indicate to the control circuit in which direction the carriage is to be moved along the rail, either in a forward direction or a rearward direction and the control circuit will operate the drive motor either clockwise or counter-clockwise. Although the hand-operated controller 18 is herein shown as being secured to the carriage 11, as previously mentioned, it could also be a remote controller and operate in a manner well known in the art.

Another function in the program memory is that once the carriage automatically displaces itself and arrives at the desired location, once arriving at the location, it will automatically operate the lift motor 25 to automatically lower the sling hanger 15 by dispensing a predetermined cable length. This predetermined cable length could be fixed so that the sling hanger is arrested at a desired height from the floor surface. It can therefore be appreciated that all the attendant needs to do to displace the patient lift from its homing position to a desired position is to actuate the switch 35 and the carriage will start displacing itself without the attendant. In the meantime, the attendant can go to the desired location and place a harness around the patient while the carriage is slowly moving along the track. As the carriage passes by stations positioned forward of the desired location, it will send an audible signal informing the attendant, herein a nurse's aide, that it is on its way. By the time the attendant has prepared the patient, the carriage arrives and the sling hanger is automatically lowered. The patient is attached to the sling hanger and the attendant uses the hand operated controller 18 to retract the cable to move the patient to a desired height and then actuates the switches 38 or 39 to displace the carriage along the rail to another position where the patient is either lowered in a bath, a wheelchair, a bed, etc. The attendant can then depress switch 37 and the sling hanger will be automatically retracted and the carriage will move back to its homing position and during this time of travel the attendant can also carry out other functions.

It is within the ambit of the present invention to cover any obvious modifications of the preferred embodiment of the present invention as described herein. For example, the predetermined locations 13 to 13'' may be identified by programming the memory to monitor the operation of the drive motor and by doing so predetermined positions may be identified by the distances travelled by the carriage along the rail.

What is claimed is:

1. A rail mounted patient lift comprising:

a ceiling mounted rail;

a carriage mounted for displacement along said rail;

power operated drive means for displacing the carriage along the rail;

a sling hanger secured to a flexible elongate support element;

power,operated lifting means for extending and retracting the elongate support element relative to the carriage;

a manually operable controller;

control circuit means for moving said carriage to a selected one of a plurality of different positions along the rail in response to a first command signal from the controller; and a load detector for detecting if a load is present on the sling hanger, the power operated lifting means being operable by the control circuit means to raise the sling hanger if in a down position with no load thereon when receiving a command signal from the controller to move the carriage along the rail.

2. The rail mounted patient lift as claimed in claim 1, wherein the control circuit means includes a programmable memory.

3. The rail mounted patient lift as claimed in claim 1, wherein the control circuit means is operable to move the carriage to a predetermined homing position in response to a second command signal from the controller.

4. The rail mounted patient lift as claimed in claim 1, wherein said control circuit means is further provided with a sling hanger lowering function to lower the sling hanger to a desired pre-programmed position upon said carriage reaching a desired location.

5. The rail mounted patient lift as claimed in claim 1, wherein said controller has first and second switches for actuating said power operated lifting means (lift motor) to raise or lower said sling hanger, a station identification switch to instruct said control circuit means of a desired location along said rail, a homing switch for said carriage to automatically return to a homing position, and forward and reverse switches to displace said carriage in a desired direction along said rail when said sling hanger is in use.

6. The rail mounted patient lift as claimed in claim 1, wherein said control circuit means identifies a selected position by detecting the distance of travel of said carriage along said rail.

7. A rail mounted patient lift comprising a ceiling-mounted rail, a carriage mounted for displacement along said rail, motorised drive means for displacing said carriage, a sling hanger secured to a retractable cable and vertically displaceable from said carriage by a lift motor, control circuit means for receiving command signals from a hand-operated controller, a load detector to detect if a load is present on said sling hanger, said control circuit operating said life motor to retract said sling hanger if in a down position with no load thereon when receiving a command signal from said control circuit to freely move said carriage on said rail from a homing position, said control circuit having a programmable memory with a homing function to automatically return said carriage to said homing position when receiving a homing signal, and means to arrest said freely moving carriage at a desired position along said rail.

8. A rail mounted patient lift comprising:

a ceiling mounted rail;

a carriage mounted for displacement along said rail;

power operated drive means for displacing the carriage along the rail;

a sling hanger secured to a flexible elongate support element;

power operated lifting means for extending and retracting the elongate support element relative to the carriage;

a manually operable controller;

control circuit means for moving said carriage to a selected one of a plurality of different positions along the rail in response to a first command signal from the controller;

a plurality of location identifying means mounted at predetermined positions along the track and detector means mounted on the carriage for detecting the presence of the location identifying means; and audible sound generator means for emitting a sound when said detector means detects any of said location identifying means to signal the movement of said carriage and its location along said rail.

9. The rail mounted patient lift as claimed in claim 8, wherein the control circuit means includes a programmable memory.

10. The rail mounted patient lift as claimed in claim 8, wherein the control circuit means is operable to move the carriage to a predetermined homing position in response to a second command signal from the controller.

11. The rail mounted patient lift as claimed in claim 8, wherein said location identifying means are magnetic elements.

12. The rail mounted patient lift as claimed in claim 11, wherein said magnetic elements are adhesively attached to said rail.

* * * * *